United States Patent [19]

Suto

[11] Patent Number: 4,964,835

[45] Date of Patent: Oct. 23, 1990

[54] AIR CUSHION VEHICLE TOY

[75] Inventor: Shohei Suto, Tokyo, Japan

[73] Assignee: Taiyo Kogyo Co. Ltd., Tokyo, Japan

[21] Appl. No.: 440,610

[22] Filed: Nov. 22, 1989

[30] Foreign Application Priority Data

Jan. 31, 1989 [JP] Japan ..... 1-9306[U]
Jun. 13, 1989 [JP] Japan ..... 1-68170[U]

[51] Int. Cl.[5] ..... A63H 23/04; A63H 29/16; A63H 17/00; B60V 1/06

[52] U.S. Cl. ..... 446/154; 446/179; 180/128; 180/122

[58] Field of Search ..... 446/179, 178, 163, 154, 446/164, 165; 180/128, 127, 122

[56] References Cited

U.S. PATENT DOCUMENTS 3,379,271 4/1968 Hopkins et al. ..... 180/128
3,589,058 6/1971 Labat ..... 446/179
4,111,277 9/1978 Peissel et al. ..... 180/122
4,313,512 2/1982 Jutras .
4,413,697 11/1983 Duneau .
4,702,332 10/1987 Prentice ..... 180/128 X

FOREIGN PATENT DOCUMENTS 2204839 2/1972 Fed. Rep. of Germany .
687334 3/1967 France .
56394 10/1981 Japan .

*Primary Examiner*—Mickey Yu
*Attorney, Agent, or Firm*—Edward D. C. Bartlett

[57] ABSTRACT

An air cushion vehicle toy has a body formed with an air inlet and levitation air vent holes. An expandable and contractible skirt is attached to a lower part of the body, and a centrifugal levitation air blower is arranged to both expand the skirt and to levitate the body. Propulsive air blowers are mounted on a body upper part, and a radio control unit may be provided for controlling all of these air blowers separately. The body incorporates a float unit for improving buoyancy. The skirt may be bag-like with a bottom provided with holes.

19 Claims, 7 Drawing Sheets

AIR CUSHION VEHICLE TOY

FIELD OF THE INVENTION

The present invention relates to air cushion vehicle toys. It particularly relates to an air cushion vehicle toy capable of freely aviating by levitating an airframe by utilizing the dynamic lift of an air cushion confined in between a bottom surface of the airframe and the ground or water surface.

BACKGROUND OF THE INVENTION

Generally, a ground effect machine is a generic name of vehicles which aviate by utilizing a lift of an air cushion confined in between the airframe bottom surface and the ground or water surface, or ground effects of wings. Popular names of these vehicles are, for instance, a Hovercraft (brand name) or an air cushion vehicle. The ground effect machines are classified roughly into two; one group includes a peripheral jet type, a pressure chamber type, and an air lubricating type which utilize a dynamic lift; another group includes ram wings and ground effect wings which utilize a dynamic lift. The peripheral jet type is a typical machine arranged in such a way that the air is jetted downwards from a peripheral part of the bottom surface of the airframe. The airframe is equipped with a flexible skirt to travel on unlevelled ground or waves.

A typical arrangement, of an existing small-sized air cushion vehicle among the ground effect machines, has a single propeller mounted on the airframe and rotated by an engine, approximately one-third of the quantity of air generated by the propeller being employed for levitating the airframe, and the remaining two-thirds of air being used for propelling the airframe.

When a battery serves as the power supply for an electromotive toy in the form of a small-sized air cushion vehicle, there is a limit to the output of the motor mounted thereon. It is difficult to obtain propulsion and also levitate the airframe by a single propeller. Where fans are separately provided for both buoyancy and propulsion, a propeller employed as a levitating fan can be part of a general air blowing means. However, the propeller has a quite poor efficiency in terms of increasing air pressure. The air flows back from the propeller, unless a motor capable of rotating at high speed and having a large torque is employed, with the result insufficient pressure is obtained to levitate the airframe. Even if the airframe is levitated by using a motor having large torque, the resultant toy is unsatisfactory in terms of the life span of the battery. The propeller has to be rotated at a high velocity, which in turn causes loud noises. Also, with a mechanism for manipulating an inclined angle of a rudder placed at the rear of the airframe for changing the propulsive direction, the responsiveness thereof in a toy is poor, thereby creating difficulty of handling.

Thus, the prior art does not provide an air cushion vehicle toy capable of obtaining both sufficient buoyancy and propulsion when using a simple battery as the power supply and freely controlling navigation with a high degree of dependability.

SUMMARY OF THE INVENTION

The general object of the present invention is to provide a new air cushion vehicle toy.

It is a primary object of the preferred embodiment of the present invention to provide a novel air cushion vehicle toy capable of acquiring sufficient buoyancy and propulsion by use of a battery as the power supply with the air cushion vehicle toy handling freely with good dependability.

According to one aspect of the invention, there is provided an air cushion vehicle toy comprising a body having an upper part perforated with an air introducing hole and a bottom part perforated with air vent holes, a skirt unit attached to a lower circumference of the body and so formed in an expandable and contractible bag-like shape as to communicate with a body interior, a levitation air blower for swelling the skirt unit while introducing the air into the body from outside via the air introducing hole and at the same time imparting levitating forces to the body by exhausting air from the air vent holes, propulsive air blowers mounted on an upper part of the body, and a control unit for controlling operations of the levitation air blower and the propulsive air blowers by supplying motive power to these components.

A float unit for providing buoyancy with respect to water may be incorporated into the body interior.

The levitation air blower is preferably a centrifugal air blower.

The control unit preferably employs the use of a radio control capable of providing remote control.

A bottom part of the skirt unit may be formed with holes.

According to the preferred embodiment of the present invention, the air is introduced into the body interior from outside via the air introducing hole by rotating the levitation air blower. The thus introduced air is fed to the skirt unit, whereby the skirt unit is expanded. Subsequently, the air is discharged from the air vent holes formed in the bottom part thereof. When the skirt unit is swollen, there is formed a predetermined air chamber defined by the skirt unit, a bottom surface of the body and the ground (or water surface). The levitation air blower causes an increase in pressure within the air chamber, whereby the body is levitated. While the body remains levitated, the air flows outside via a narrow gap between the skirt unit and the ground (or water surface), thus reducing frictional resistance therebetween. The propulsion is controlled by regulating the rotation of the propulsive air blowers while the air frame remains afloat. The propulsive air blowers are provided independently of the levitation air blower, and well-responsive handling is practicable by controlling the operation of the propulsive air blowers.

It is possible to obtain a higher pneumatic pressure than in the case of using a propeller and also sufficient buoyancy by employing a centrifugal air blower operable by a battery as the levitation air blower.

If a float unit for imparting buoyancy with respect to water is incorporated in the body interior, the airframe floats on the water surface even when the rotation of the levitation air blower is stopped, and this blower can be reactuated while standing afloat on the water surface.

When a radio remote control unit is used, the remote control in turn adds amusement.

By forming holes in the bottom part of the float unit, it is feasible to remove any water penetrating therein via other holes while it is operating on water, thereby providing uniform friction and stabilizing the travelling condition.

According to another aspect of the invention, there is provided an air cushion vehicle toy comprising a body containing a float unit and a battery compartment, the body having an air inlet and a plurality of downwardly directed discharge air vents, a bag-like hollow skirt extending downwardly from below the body around an outer periphery thereof, a centrifugal air blower disposed below the air inlet and connected to discharge air into the bag-like skirt to expand the latter and to discharge air through the air vents to provide levitation, at least one propulsive air blower mounted on said body, and control means for supplying electric power from the battery compartment to the air blowers and for controlling operation of each of these air blowers separately.

When air escape holes are provided in the bottom of the bag-like skirt, these holes are preferably directed downwardly and inwardly with respect to the outer periphery of the body.

Other objects, features and advantages of the present invention will become more fully apparent from the following detailed description of the preferred embodiments, the appended claims and the accompanying drawings.

BRIEF DESCRIPTION OF THE DRAWINGS

In the accompanying drawings, in which like reference characters indicate like parts.

DETAILED DESCRIPTION OF THE PREFERRED EMBODIMENTS

Figure 1:
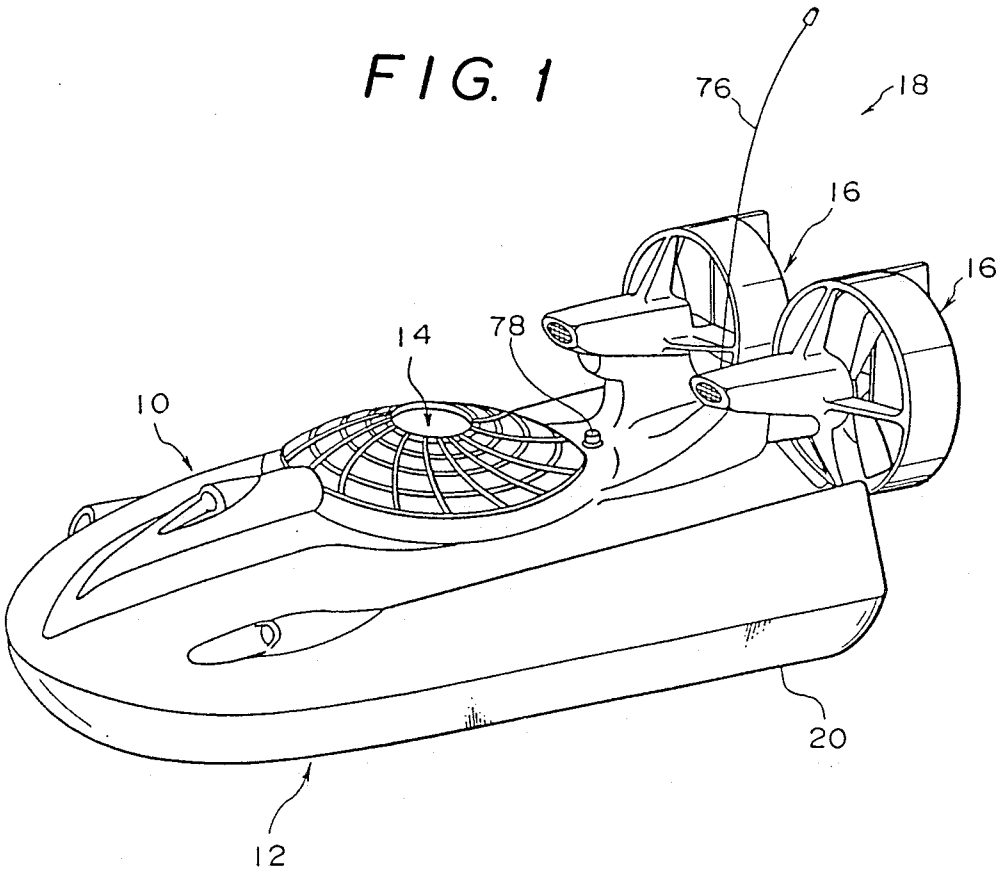
FIG. 1 is a perspective view of an air cushion vehicle toy according to the present invention.

FIGS. 1 to 7 show by way of example a first embodiment of an air cushion vehicle toy of the present invention; and FIGS. 8 to 11 illustrate a second embodiment similar to the first embodiment but having an improved skirt unit.

Referring now to FIGS. 1 to 7, the air cushion vehicle toy of the first embodiment is composed of a body 10 serving as an airframe, a skirt unit 12 provided along and around the circumference of a bottom surface of the body 10, a levitation air blower 14 incorporated into the body 10, a couple of propulsive air blowers 16 mounted on an upper portion of the body 10 at the rear thereof, and a control unit 18 for radio-controlling operations of the levitation air blower 14 and the propulsive air blowers 16. Based on this construction, the air cushion vehicle toy gives amusement by freely travelling above the ground (or water surface) 20.

The body 10 consists of an upper body 22 constituting an upper part of the air frame, and a seal box body 24 constructed on the underside thereof. The upper body 22 and the seal box body 24 are formed of plastic material such as ABS (Acrylonitrilo Butadiene Styrene Copolymer) or the like. The upper body 22 has its front part assuming a substantially semi-circular configuration and its rear part assuming a rectangular configuration, and is formed as a flat cover-like shape which is elongate in the fore and aft direction. Namely, the upper body 22 is shaped to imitate an airframe of a small-sized air cushion vehicle A substantially central part of the upper body 22 is perforated to form a circular air introducing hole 26 above which a fan cover 28 is detachably attached to the upper body 22. The fan cover 28 covers the air introducing hole 26 from the outside, the arrangement being such that the cover 28 is composed of swirly ribs and ring-like ribs to form a part of a spherical surface, thus permitting air ventilation. The fan cover 28 is shaped to assume a configuration similar to swirls of a typhoon. The thus constructed fan cover 28 is formed of a plastic material such as ABS. Chased in the entire circumference of the upper body 22 is a downward mounting groove 30 for mounting the skirt unit 12 which will be described later in more detail. Protruding downwards, at predetermined positions of an inner surface of the upper body 22, are a plurality (seven pieces in this embodiment) of bar-like bosses 32 for fixing the seal box body 24.

The seal box body 24 is formed slightly smaller than the upper body 22 to assume a substantially rectangular configuration which is elongate in the fore and aft direction. A plurality (six in this embodiment) of air vent holes 34 perforate the bottom of the body 10 outside but in the vicinity of the circumference of the seal box body 24. The front upper part of the body 24 is sectioned by partitions to provide a region or compartment for accommodating a battery 36. Each air vent hole 34 is formed in a cylindrical shape protruding upwards a predetermined distance to prevent water entering into the interior of the body 10 when the airframe floats on water for use thereon. More specifically, the cylindrical length of each air vent hole 34 is selected so that the upper opening the cylindrical vent is higher than the water level when the toy vehicle floats on the water after landing thereon. Sizes, placement and the number of the air vent holes 34 are determined depending on the air displacement capacity of the levitation air blower 14 and sizes or positions of other components. Formed on an upper surface of the seal box body 24 is a tabular rib 38 slightly protruding upwards to surround the region rear of the battery compartment, the rib 38 passing inwardly of the air vent holes 34. A top part of the rib 38 is, as illustrated in enlargement in FIG. 5, chased with a substantially Vshaped sealing groove 40 into which a ribbon-like shield packing 42, formed of a material such as rubber or the like, is fitted. A mounting groove 44, for mounting the skirt unit 12, is formed in such a position on a lower edge surface of the seal box body 24 as to establish a constant size horizontal gap from the mounting groove 30 of the upper body 22.

Provided on the upper part (inside of the body 10) of the seal box body 24 is a shield box cover 46, shaped to provide a predetermined air passageway between the inner surface of the upper body 22 and itself, for covering an upper part of the region surrounded by the sealing groove 40. A circumferential edge of the shield box cover 46 impinges on the shield packing 42 fitted into the sealing groove 40. To be specific, the interior of the body 10 is formed with a closed and sealed air space 48 defined by the box body 24 and the box cover 46. The closed air space 48, as will hereinafter be described in greater detail, internally accommodates electric parts of the control unit 18 or the like, thus waterproofing these parts. The closed air space 48 also serves as a float unit for imparting buoyancy with respect to water. The closed air space 48 is formed of an adequate size to function as the float unit of the toy vehicle, including the electrical components, and of a size to accommodate the sizes of the enclosed electric parts. Fixing members 50 and 52 are provided in such positions of the box cover 46 and the box body 24 as to correspond to tips of the bosses 32 of the upper body 22. The fixing member 40 (see FIG. 2) of the box cover 46 is sandwiched in between the tip of the boss 32 and the fixing member 52 of the seal box body 24, in which state these members are fixed together from the underside with unillustrated machine screws. The thus effected fixing serves to fasten and compress the shield packing 42, with the result that the closed air space 48 is sealed for preventing water penetration therein.

The skirt unit 12, which is secured to the circumference of the bottom surface of the body 10, is swollen or formed to assume a substantially semi-circular bag-like shape in section. The skirt unit 12 is constructed in such a manner that skirt mounting wires 56 (see FIG. 5), each composed of a narrow and long vinyl wire, are provided on both sides of a waterproofed band of cloth 54 formed of a soft material, and the band-like cloth 54 is formed in a ring-like shape. In the thus constructed skirt unit 12, the band-like cloth 54 may also be formed of a plastic sheet of soft rubber or vinyl. In this case, the band-like cloth is formed preferably of such a material as to reduce any frictional resistance with respect to the ground. The skirt unit 12 undergoes a waterproofing treatment to prevent both water permeation into the interior of the body 10 and an increase in weight due to water absorption. Mounting of the skirt unit 12 involves the step of fitting the skirt mounting wires 56, provided on both sides of the band-like cloth 54, into the mounting groove of the upper body 22 and the mounting groove 44 of the seal box body 24, respectively. More specifically, the skirt unit 12 is secured to and around the entire circumference of the bottom surface of the body 10 so that the interior of the skirt unit 12 communicates with the interior of the body 10 to form an expandable and contractible bag-like shape.

The levitation air blower 14 consists of a levitation motor 58 which rotates with the battery 36 serving as the power supply, and a centrifugal air wheel fan 60 formed of a plastic material such as ABS and fixed to a rotary drive shaft of the levitation motor 58. The levitation motor 58 is disposed in the closed air space 48, and the rotary shaft thereof is protruded from the closed air space 48 and directed to the air introducing hole 26. The air wheel fan 60 is so disposed as to face towards the air introducing hole 26 of the upper body 22. The air wheel fan 60, classified as a centrifugal type for use with a compressor or an air blower for general industries, is miniaturized to be rotatable by a battery or the like. The air passes through passages in the impeller in a radial direction and is pressurized mainly by action of centrifugal force.

Each propulsive air blower 16 comprises a propulsive motor 62 which is rotated by a battery 34 serving as the power supply, a propeller 64 fitted to a rotary shaft of the propulsive motor 62 and formed of a plastic material such as PP (polypropylene), a motor case 66 formed of a plastic material such as ABS, a propeller cover 68; and a rudder or fin 70. The motor case 66 incorporates the motor 62 with its rotary shaft directed rearwards. The rotary shaft is provided with the propeller 64 shrouded within the cylindrical propeller cover 68. Attached pivotally to a rear inside portion of the propeller cover 68 is the rudder 70 for changing the direction of air blowing. A couple of thus arranged propulsive air blowers 16 are bilaterally installed side by side on the rear upper part of the upper body 22, as particularly clearly shown in FIG. 1.

The control unit 18 comprises the battery 36 for driving the levitation motor 58 and the propulsive motors 62, a radio-controlled receiver and an unillustrated transmitter. The battery 36 is composed of six or eight units of, e.g., small-sized dry batteries accommodated in the battery compartment in front of the seal box body 24. The radio-controlled receiver includes a receiving circuit 74 provided on a printed circuit board 72 disposed in the closed air space 48, and an antenna 76, extending upwardly from the rear of the upper body 22, for receiving radio waves transmitted from the unillustrated radio transmitter. Provided at the rear of the printed circuit board 72 is a switch 78 for turning ON/-OFF the power supply to the receiving circuit 74. A button of the switch 78 is exposed through the upper body 22 above the shield box cover 46, whereby the button can effect the switching ON/OFF from externally of the toy. Electric parts such as the levitation motor 58, the receiving circuit 74 and the switch 78 are accommodated in the closed air space 48 which does not permit infiltration of water, thus waterproofing these parts. The transmitter of the radio control is used typically for transmitting control signals in the form of radio waves. The control signals are transmitted as radio waves for controlling propulsive directions by levitating the airframe with rotation of the levitation air blower 14 and rotating forwards or backwards the propulsive air blowers 16. For this purpose, the transmitter is equipped with a main switch, a power switch for turning ON/OFF the levitation air blower 14 and a control stick for controlling the propulsive directions.

Operations of the thus constructed air cushion vehicle toy will now be described.

To start with, the air cushion vehicle toy is placed on the ground or other surface. When turning ON the switch 78, the receiving circuit 74 is energized, and there is created a standby state in which the radio waves transmitted from the unillustrated transmitter can be received. At this time, the skirt unit 12 remains stationary on the ground 20 in a contracted or collapsed state.

Figure 2:
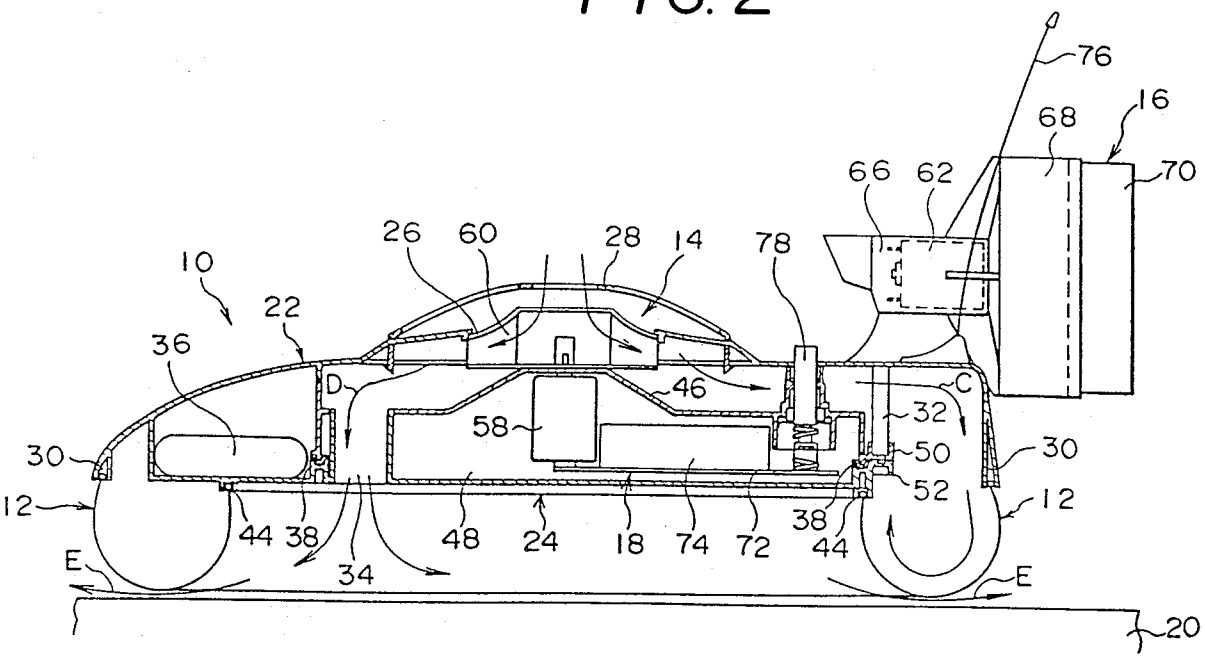
FIG. 2 is a longitudinal sectional view thereof.
Figure 3:
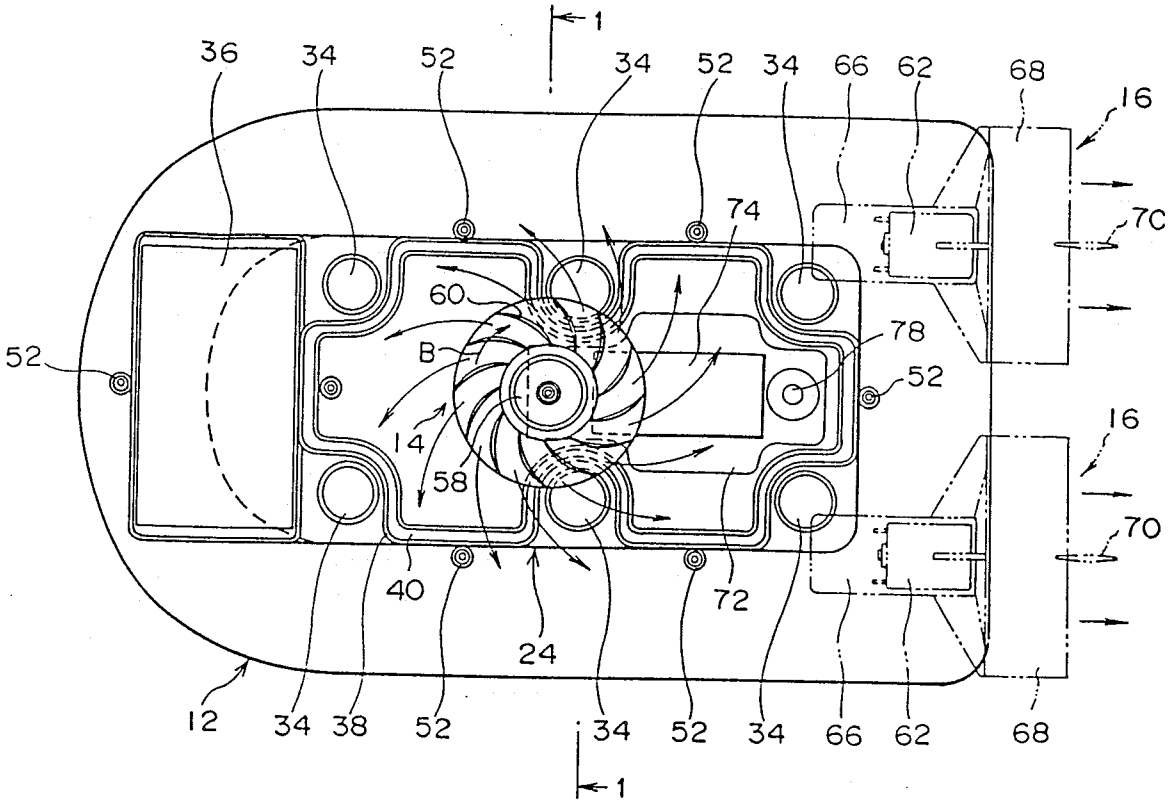
FIG. 3 is a plan view thereof with parts omitted to illustrate the body interior.
Figure 4:
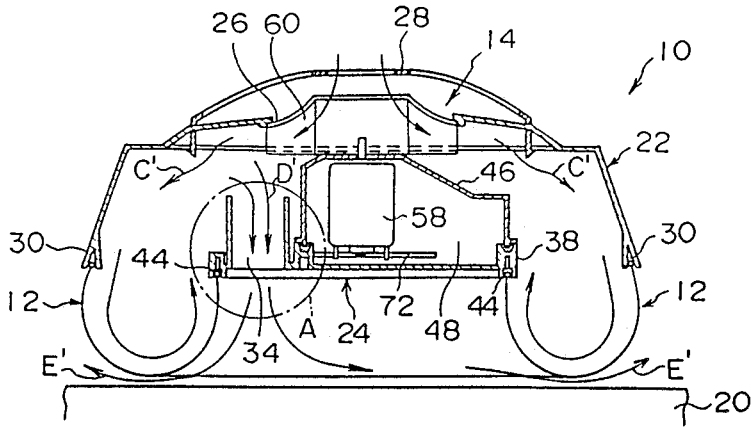
FIG. 4 is a sectional view taken substantially along the line 1—1 of FIG. 3.
Figure 5:
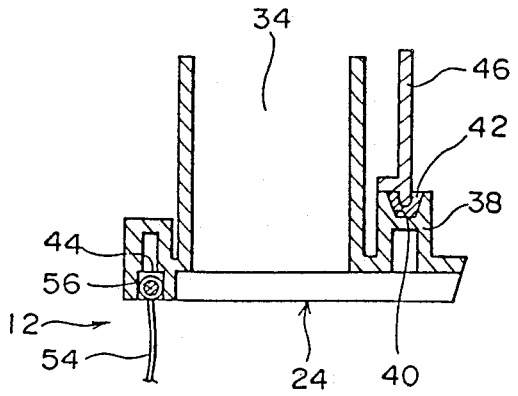
FIG. 5 is an enlarged view of the portion A of FIG. 4.
Figure 6:
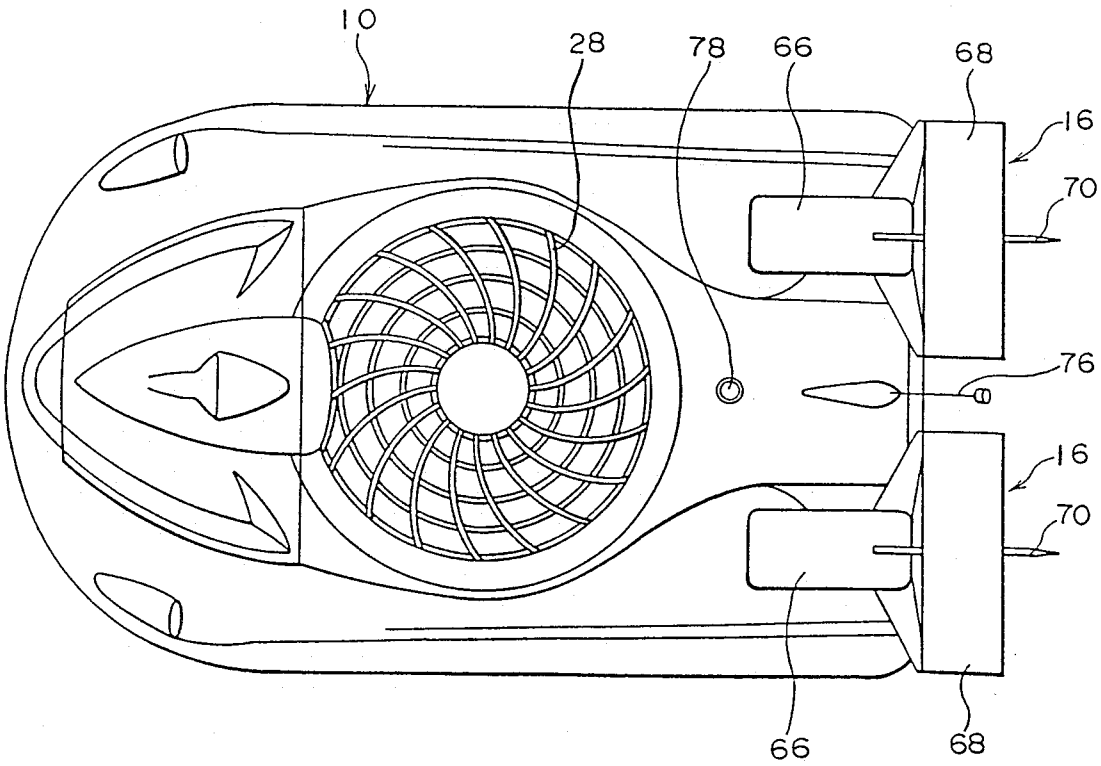
FIG. 6 is a plan view of the air cushion vehicle toy.
Figure 7:
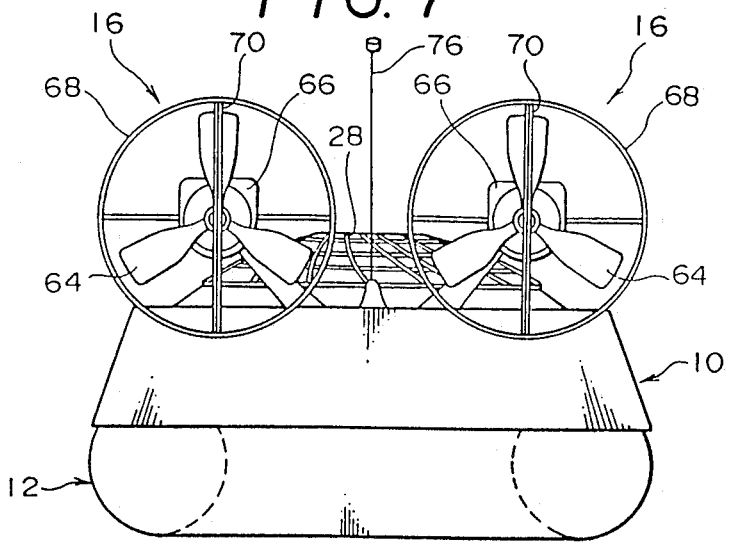
FIG. 7 is a rear elevational view thereof.
Figure 8:
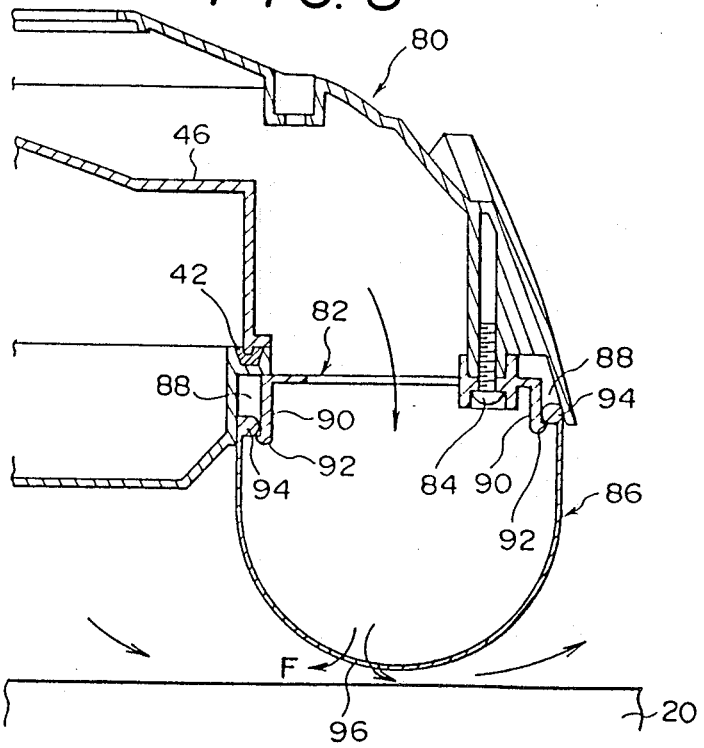
FIG. 8 is a sectional view illustrating mounting the skirt unit of a second embodiment of an air cushion vehicle toy according to the invention.
Figure 9:
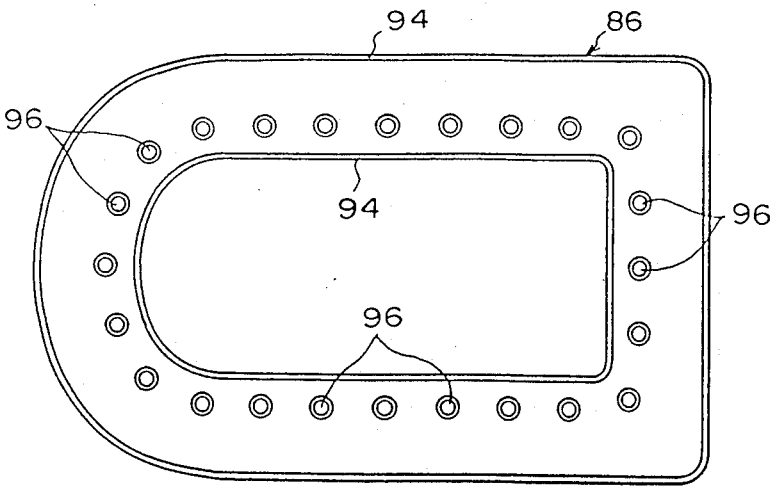
FIG. 9 is a plan view of the skirt unit of the second embodiment of FIG. 8.
Figure 10:
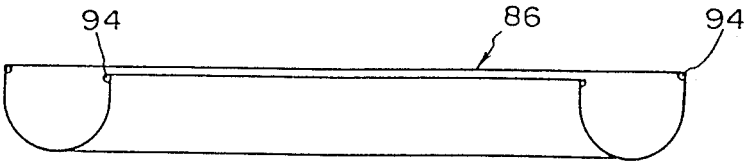
FIG. 10 is a longitudinal sectional view of the skirt unit of FIG. 9.
Figure 11:
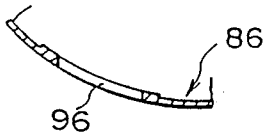
FIG. 11 is an enlarged sectional view of a portion of the skirt unit of FIG. 8 illustrating one of the holes in the skirt unit.

Next, simultaneously when energizing the transmitting circuit by turning ON the main switch of the transmitter, the radio waves of the levitation control signals are transmitted. The radio waves of the levitation control signals are received by the receiving circuit 74 via the antenna 76. Based on these signals, the levitation air blower 14 is activated and driven. To be more specific, when the air wheel fan 60 is rotated in a direction indicated by an arrow B of FIG. 3 by means of the levitation motor 58, the outside air is sucked via the fan cover 28 and the air introducing hole 26 into the body 10. The sucked air passes through an air passageway defined by the upper body 22 and the shield box cover 46 and is partially, as illustrated in FIGS. 2 and 4, fed into the skirt unit 12, following the lines indicated by arrows C and C'. The remaining air is fed directly into the air vent holes 34, following the lines indicated by arrows D and D'. Subsequently, the skirt unit 12 is expanded as the air blown therein increases in pressure, with the result that the body 10 is slightly raised. There is thus formed an air chamber defined by the skirt unit 12, the seal box body 24 and the ground 20 thereunder. When the pressure of the air discharged via the air vent holes 34 into this air chamber increases, as illustrated in FIGS. 2 and 4, the air flows to the outside of the vehicle along the lines indicated by arrows E and E' through a narrow gap between the bottom of the skirt unit 12 and the ground 20, and the frictional resistance between these is thereby reduced. As a result, the airframe stands afloat in a stopped or stationary position.

To move the airframe forwards, an advancing operation is effected by use of the control stick of the transmitter. In consequence of this, the radio waves of the advancement control signals are transmitted from the transmitter to the receiver 74 to energize the motors 62 and thereby rotate the two propellers 64 in the forward direction. This causes the airframe 10 to move forwards. At this time, the pivotal inclinations of the rudders 70 and 70 are so adjusted that the airframe goes straight. Whereas for rearward movement, the transmitter is changed to reverse operation and the two propellers 64 are rotated in the reversed direction. When changing the advancing direction for turning to the right or left, one of the propellers 64 may be rotated in the forward or reversed direction by appropriately operating the transmitter. In the case of turning the airframe 10 to the right or left when in the stopped position, one propeller 64 is rotated in the forward direction and the other propeller 64 is rotated in the reversed direction. Good responsive and reliable handling can be attained by controlling the drive motors 62 to effect operation of the two propulsive air blowers 16 separately or in combination and in either direction.

During propulsion of the vehicle, if an emergency shutdown is required, a power switch for the levitation air blower 14 on the transmitter is turned OFF, thus stopping the drive of the levitation air blower 14. Then, the skirt unit 12 contracts so increasing the frictional resistance with the ground 20, at which time the emergency shutdown takes place.

Disposed in the closed air space 48, covered with the shield box cover 46 in the body 10, are the electric parts such as the levitation motor 58, the receiving circuit 74 and the switch 78. This arrangement prevents water contamination thereof. The closed air space 48 also functions as a float unit with respect to the water, whereby the toy vehicle as a whole is enabled to float on the water surface while being stationary. For this, the cylinders of the air vent holes 34 extend upwardly to higher than the water level, and further the skirt unit is waterproofed. Hence, the water does not penetrate into the closed air space 48 or inside the skirt unit 12 by flowing over the upper portion thereof, but instead stays at a given level within the air vent holes 34. Thus, the airframe 10 is usable on the water surface.

As discussed above, the levitation air blower 14 employs the centrifugal air wheel fan 60 which is driven by battery power. With this arrangement, it is possible to obtain an almost two-fold buoyancy with torque which is approximately one-half that in the case of using propellers. Remarkable efficient results are obtained. Besides, the levitation air blower 14 can be diminished in size, and noise can also be reduced down to an almost unperceptible level. The two propulsive air blowers 16 are arranged to rotate in the forward or reversed direction and stop separately from each other, which arrangement provides higher responsiveness in maneuverability than in the case of only using the rudders 70. Thus, the airframe can be maneuvered freely.

A modification of the above air cushion vehicle toy, according to the invention, has the same mechanical components as those in the preceding embodiment. A difference is that the control unit controls ON/OFF operations of the levitation air blower 14 and the propulsive air blowers 16 by supplying them with electric power from outside by using a wire lead connection without employing the radio control. The air cushion vehicle toy in this modification exhibits an advantage in which the electric power and/or the control signals are supplied to the levitation air blower 14 and the propulsive air blowers 16 by connecting the wires thereto, thereby enabling aviating of the toy within a wire extendable range. In this embodiment, there is no necessity for installing a battery in the toy vehicle. This in turn brings about a reduction in weight of the airframe and facilitates levitation as well as simplifying the structure.

FIGS. 8 to 11 are views of assistance in explaining the air cushion vehicle toy of the previously mentioned second embodiment of the invention. Note that the components corresponding to those in the first embodiment are marked with the same reference characters, and further detailed description thereof is not necessary.

A characteristic arrangement of the air cushion vehicle of the second embodiment is an improvement of the skirt unit. Referring to FIGS. 8 to 11, a skirt unit mounting member 82, formed in a frame-like configuration, is fixed with machine screws 84 to a lower circumference of a body 80 which constitutes the airframe and is shaped in the same manner as that in the first embodiment. A skirt unit 86 is mounted by this skirt mounting member 82.

The skirt mounting member 82 assumes the frame-like shape to communicate with the interior of the body 80, and includes a crooked member 90 formed downwards on an end part to form groove 88 between the body 80 and itself. A stopper pawl 92 is provided at a lower end of the crooked member 90. The skirt unit 86 assumes a substantially semi-circular shape in section, and has its upper end provided with a mounting member 94 similar to a continuous flange bead and its lower part perforated with a multiplicity (24 pieces in this embodiment) of small holes 96 at equal spacings. The centers of these holes 96 are positioned slightly inwards from a bottom part of the skirt unit 86, and peripheral parts of these holes 96 are formed relatively thick for increased strength. Thus, the holes 96 are directed downwardly and inwardly with respect to the outer periphery of the body 10. The skirt unit 86 is integrally manufactured by rubber molding. The skirt unit 86 is mounted by fitting the skirt mounting member 94 into the groove 88. Other components are the same as those in the first embodiment.

In the thus constructed air cushion vehicle toy, when the airframe stops afloat on the water surface, the water permeates the skirt unit 84 via the holes 96. When the internal pressure of the airframe increases after rotating the air wheel fan 60 for levitation, however, the skirt unit 86 is expanded, thereby discharging the water permeated inside from the holes 96. After the water has completely been discharged, air flows out of the skirt unit 84 into the levitating air chamber via each hole 96, mainly along the line indicated by an arrow F. As a result, the internal pressure in the air chamber increases to levitate the airframe.

Where the skirt unit 12 is closed, as in the first embodiment, ingress of water still tends to occur if the airframe remains afloat on the water surface for a long period of time. Once water has penetrated into the skirt unit, it is difficult to remove such water from the airframe in a short time, which leads in some cases to trouble in travelling of the airframe. In this second embodiment, however, such a problem can be eliminated. If the holes 96 are not formed, air outflow under the skirt unit may become non-uniform as it depends on the size of gap between the skirt unit and the ground 20; this can result in instability in travelling, because the frictional forces become more concentrated at particular locations.

In the second embodiment, however, the holes 96 from which air is discharged, are equally distributed over the bottom of the skirt unit 86. Owing to this configuration, even if the ground has more or less rugged portions, there is less likelihood that frictional resistances will be concentrated at particular locations, thus providing more stable travel. In accordance with this embodiment, the skirt unit 86 is integrally manufactured by rubber molding, so improving dimensional accuracy as compared with manufacture from cloth. Furthermore, mass productivity can be ameliorated.

Note that in the above-described embodiments, the air cushion vehicle toy is usable not only on ground or water for amusement, but also on the floor, a mat, or even on a desk. If not to be used on a water surface, it is unnecessary to provide the float unit or enclose the electric parts for preventing water penetration, thereby simplifying the structure.

In the foregoing embodiments, the float unit is provided by forming the closed air space 48 defined by the seal box body 24 and the shield box cover 46. It is also possible to employ an air-filled bag floatable on the water surface, or a foam member in the body 10 or 80.

The levitation air blower 14 in the above-described embodiments involves the use of a centrifugal air wheel fan. However, other types of air blowers may also be employed provided they are operable by a battery or the like and have a configuration adapted to sufficiently increase the air pressure. If problems peculiar to noise and efficiency can be eliminated, propellers may be employed as air blower fans. There have been exemplified two propulsive air blowers 16 in the description given above. Only one or, if necessary, more than two propulsive air blowers can be provided; and their locations for installation are not limited. When rotating the blades of the air blower propellers 64 in directions opposite to each other, and if they are orientated in opposite directions to make the air blowing directions coincident with each other, the forward or backward movement can be stabilized by offsetting any gyroscopic moment.

It is to be noted that the bodies 10, 80 are preferably formed of plastic materials such as ABS, but other materials may be used. It is important to manufacture the body with a considerable strength by use of a light material. The bodies 10 and 80 can be formed in a variety of configurations depending on the designs. The shape of the levitation fan cover 28 can arbitrarily be selected and, as the case may be, even omitted. The battery 36, the levitation air blower 14, and the propulsive air blowers 16 are preferably disposed to equalize distribution of the total weight.

In the second embodiment above, the positions, the sizes, and the number of the holes 96 in the skirt unit 86 are determined taking travelling balance into consideration.

As discussed above, the body of the air cushion vehicle toy incorporates the levitation air blower and the propulsive air blowers driven independently of each other by a power supply such as a battery. With this arrangement, it is feasible to obtain sufficient buoyancy and propulsion and provide free handling with excellent dependability.

Although the illustrative embodiments of the present invention have been described in detail with reference to the accompanying drawings, it is to be understood that the invention is not limited to those embodiments. Various changes or modifications may be effected therein by one skilled in the art without departing from the scope or spirit of the invention as defined in the appended claims.

What is claimed is:

1. An air cushion vehicle toy, comprising:

a body containing a float unit and a battery compartment;

said body having an air inlet and a plurality of downwardly directed discharge air vents;

a bag-like hollow skirt extending downwardly from below said body around an outer periphery thereof;

a centrifugal air blower disposed in communication with said air inlet and connected to discharge air into said baglike skirt to expand the latter and to discharge air through said air vents to provide levitation;

propulsive air blowers mounted on said body;

control means for supplying electric power from said battery compartment to each of said air blowers and for controlling operation of each of said air blowers separately;

said float unit comprising a sealed box containing air and also containing electrical components; and said centrifugal air blower being driven by an electric motor which is housed in said sealed box, a drive shaft of said motor extending upwardly through a top of said sealed box.

2. The air cushion vehicle of claim 1, wherein said propulsive air blowers are located at a rear end of said vehicle toy, and each propulsive air blower is provided with a pivotal rudder.

3. The air cushion vehicle of claim 2, wherein said bag-like skirt is U-shaped in cross-section.

4. An air cushion vehicle toy, comprising:

a body containing a float unit in the form of a sealed box;

said body having an air inlet and a plurality of downwardly directed discharge air vents, said air vents being spaced around but outside said sealed box;

a bag-like hollow skirt extending downwardly from below said body around a periphery thereof to define a levitation air chamber below said body;

a levitation blower communicating with said air inlet and discharging air into an air passageway disposed between an upper portion of said body and a cover of said sealed box, said air passageway distributing air to said air vents and also being in communication with said bag-like skirt for expanding the latter;

a propulsive blower mounted on said body and spaced from said levitation blower;

a control unit for controlling operation of said blowers, said control unit being disposed in said sealed box and including a radio receiving circuit for remote control;

an antenna mounted on said body for receiving radio signals for said receiving circuit; and a battery unit disposed in said body for powering said blowers.

5. The air cushion vehicle toy of claim 4, wherein said blowers are separately controllable by said control unit.

6. The air cushion vehicle toy of claim 5, wherein said bag-like skirt has a bottom provided with air discharge holes.

7. An air cushion vehicle toy, comprising:

a body having an upper part perforated with an air introducing hole and a bottom part perforated with air vent holes;

a skirt unit attached to a lower circumference of said body and having an expandable and contractible bag-like shape which communicates with an interior of said body;

a levitation air blower for expanding said skirt unit while introducing air into said body from outside via said air introducing hole, and at the same time imparting levitating forces to said body by exhausting air through said air vent holes, said levitation blower having an impeller in the form of a centrifugal fan wheel;

two propulsive air blowers mounted on said upper part of said body, said two propulsive air blowers being disposed side by side at a rear end of said vehicle toy with said levitation air blower being disposed forwardly of the two propulsive air blowers;

a control unit for controlling operation of said levitation air blower and said propulsive air blowers;

a float unit for providing buoyancy of the air cushion vehicle toy with respect to water, the float unit comprising a sealed box with a cover and being mounted below said body upper part and forming part of said body bottom part;

a bottom central part of said skirt unit being formed with holes herein, said holes being directed downwardly and slightly inwardly from said skirt;

a battery compartment for containing a battery power source for powering the air blowers, said battery compartment being formed between said body upper and lower parts forwardly of said sealed box; and an electric motor mounted in said float unit with a drive shaft of said electric motor extending upwardly through said sealed box cover and said fan wheel being mounted on said drive shaft.

8. The air cushion vehicle toy of claim 7, wherein said levitation air blower discharges air into an air passageway located between said body upper part and said sealed box cover, and said vent holes and said skirt unit communicate with said air passageway.

9. The air cushion vehicle toy of claim 7, wherein each of said propulsive air blowers comprises a unit having an electric motor with a motor shaft extending rearwardly, a propeller mounted on a rear end of this motor shaft, a propeller cover mounted on said electric motor of said unit and surrounding the propeller, and a rudder pivotally mounted in a rear portion of the propeller cover.

10. The air cushion vehicle toy of claim 9, wherein with each said propulsive air blower, the propeller cover and the respective rudder overhang rearwardly beyond said rear end of said vehicle toy.

11. The air cushion vehicle toy of claim 7, wherein said sealed box is attached to said body upper part by a plurality of bosses, and said air vent holes are formed as vertically extending cylinders which are spaced apart around an outer periphery of said sealed box.

12. An air cushion vehicle toy, comprising:

a body containing a float unit and a battery compartment;

said body having an air inlet and a plurality of downwardly directed discharge air vents;

a bag-like hollow skirt extending downwardly from below said body around an outer periphery thereof;

a centrifugal air blower disposed in communication with said air inlet and connected to discharge air into said baglike skirt to expand the latter and to discharge air through said air vents to provide levitation;

two propulsive air blowers mounted on said body;

control means for supplying electric power from said battery compartment to each of said air blowers and for controlling operation of each of said air blowers separately;

said propulsive air blowers being located side by side at a rear end of said vehicle toy, and each propulsive air blower being provided with a pivotal rudder;

each said propulsive air blower comprising an electric motor with a rearwardly extending drive shaft, a propeller mounted on a rear end of the drive shaft, and a cylindrical cover supported from said motor and surrounding said propeller, said rudder being pivotally mounted in a rear portion of said cylindrical cover; and each said cylindrical cover and associated rudder overhanging rearwardly of said vehicle toy rear end.

13. An air cushion vehicle toy, comprising:

a body having an upper part and a lower part;

said upper part having an air intake hole therein;

said lower part comprising a sealed box which forms a float unit to provide buoyancy to the vehicle toy when in water so enabling the vehicle toy to float on water;

an air distribution passageway defined in said body and communicating with said air intake hole;

an inflatable skirt disposed around said body and when inflated extending downward below said body to define an air cushion space, said air distribution passageway communicating with an interior of said inflatable skirt;

a plurality of air vent holes providing communication between said air distribution passageway and said air cushion space;

levitation means, supported by said body, for drawing air in through said air intake hole and discharging air through said air distribution passageway into said inflatable skirt and into said air vent holes;

propulsive means, mounted on said body, for propelling said vehicle toy over land or water; and said levitation means including an electric motor having a drive shaft, said electric motor being mounted inside said sealed box with said drive shaft extending upwardly through a top of said sealed box.

14. The air cushion vehicle toy of claim 13, wherein said inflatable skirt is of U-shape in cross section and has a plurality of air discharge holes equally spaced apart all around the bottom of said skirt, each of said discharge holes being slightly inwardly offset from the center of the bottom of said U-shape cross section.

15. The air cushion vehicle toy of claim 14, wherein said levitation means comprises a centrifugal fan wheel mounted on an upper end of said drive shaft.

16. The air cushion vehicle toy of claim 15, wherein said centrifugal fan wheel is disposed in said air intake hole, and a dome-like fan cover extends over said fan wheel and said air intake hole, said fan cover comprising swirly ribs and ringlike ribs which together form part of a spherical surface.

17. The air cushion vehicle toy of claim 13, further comprising:

an electrical control unit for controlling operation of said propulsive means and said levitation means, said control unit being mounted inside said sealed box; and an on/off switch for said control unit, said switch being located in said sealed box and having a manual actuating button extending upwardly through said sealed box top and said body upper part.

18. The air cushion vehicle toy of claim 13, wherein:

said air vent holes are formed by vertically disposed cylinders spaced around an outer periphery of said sealed box;

said body has a forward end and a rear end and is formed with a battery compartment adjacent but forwardly of said sealed box, all said air vent hole cylinders being disposed rearwardly of said battery compartment;

said air vent hole cylinders extending upwardly higher than the water level when the vehicle toy floats on water with said levitation means inoperative; and said inflatable skirt is waterproofed.

19. An air cushion vehicle toy, comprising:

a body having an upper part perforated with an air introducing hole and a bottom part perforated with a plurality of spaced apart air vent holes, said body having a forward end and a rear end;

a skirt unit attached to a lower circumference of said body and having an expandable and contractible bag-like shape which communicates with an interior of said body, said skirt unit surrounding an air cushion space;

a levitation air blower for expanding said skirt unit while introducing air into said body from outside via said air introducing hole, and at the same time imparting levitating forces to said body by exhausting air through said air vent holes, said levitation blower having an impeller in the form of a centrifugal fan wheel rotatable about a vertical axis;

two propulsive air blowers mounted on said upper part of said body, said two propulsive air blowers being disposed side by side at said rear end of said body with said levitation air blower being disposed forwardly of the two propulsive air blowers;

a control unit for controlling operation of said levitation air blower and said propulsive air blowers;

a float unit for providing buoyancy of the air cushion vehicle toy with respect to water, the float unit comprising a sealed box with a cover and being mounted below said body upper part and forming part of said body bottom part;

said sealed box being attached to and spaced from said body upper part by a plurality of downwardly extending bosses, said air vent holes being formed as vertically extending cylinders spaced apart around an outer periphery of said sealed box;

a bottom central part of said skirt unit being formed with holes herein, said holes being directed downwardly and slightly inwardly from said skirt towards said air cushion space;

a battery compartment for containing a battery power source for powering the air blowers, said battery compartment being formed between said body upper and lower parts forwardly of said sealed box and forwardly of all said air vent holes;

an electric motor mounted in said float unit with a drive shaft of said electric motor extending upwardly through said sealed box cover and said centrifugal fan wheel being mounted on said drive shaft;

an air distribution passageway formed inside said body between said body upper part and said sealed box cover, said levitation air blower discharging air into said air distribution passageway which communicates with said vent holes and said skirt unit;

each of said propulsive air blowers comprising a unit having an electric motor with a motor shaft extending rearwardly, a propeller mounted on a rear end of this motor shaft, a propeller cover mounted on said electric motor of said unit and surrounding the propeller, and a rudder pivotally mounted in a rear portion of the propeller cover;

said control unit being mounted inside said sealed box together with an on/off switch for said control unit, said switch having a manual actuating button which extends upwardly through said sealed box cover and said body upper part and is accessible from above the vehicle toy; and said air introducing hole being disposed centrally of said body upper part and being covered by a dome-shaped cover comprising swirly ribs and ring-like ribs which together form part of a spherical surface.

* * * * *